US006637051B1

(12) United States Patent
Swart

(10) Patent No.: US 6,637,051 B1
(45) Date of Patent: Oct. 28, 2003

(54) OVERFLOW AND DRAIN CONTROL FOR A BATHTUB

(75) Inventor: Peter W. Swart, Oostburg, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/246,663

(22) Filed: Sep. 18, 2002

(51) Int. Cl.[7] ..... E03C 1/23
(52) U.S. Cl. ..... 4/688; 4/694
(58) Field of Search ..... 4/541.1–541.5, 4/584, 591, 679, 680, 688–694

(56) References Cited

U.S. PATENT DOCUMENTS 3,314,082 A 4/1967 Minella
4,594,738 A 6/1986 Gebert
4,796,310 A 1/1989 Freville et al.
4,945,579 A 8/1990 Husting
5,305,478 A 4/1994 Potter, Jr.
5,363,519 A 11/1994 Husting
6,360,380 B1 3/2002 Swart et al.

*Primary Examiner*—Charles E. Phillips
(74) *Attorney, Agent, or Firm*—Quarles & Brady LLP

(57) ABSTRACT

Disclosed is a bathtub drain arrangement for implementation in a soaker bathtub of the type having a main basin coupled to a surrounding overflow trough. There is a drain channel extending from under the trough. There is also a drain pipe for draining water from the main basin. A drain control is positioned in the trough to extend into the drain channel and then outward there from.

6 Claims, 3 Drawing Sheets

FIG. 3
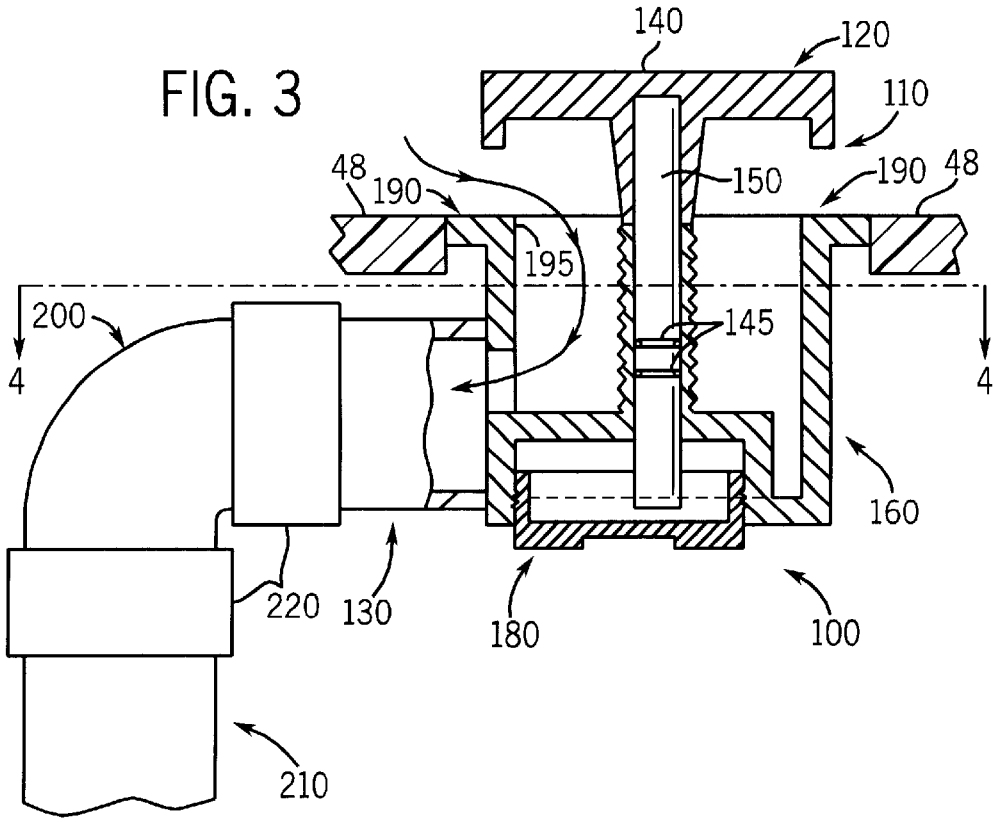
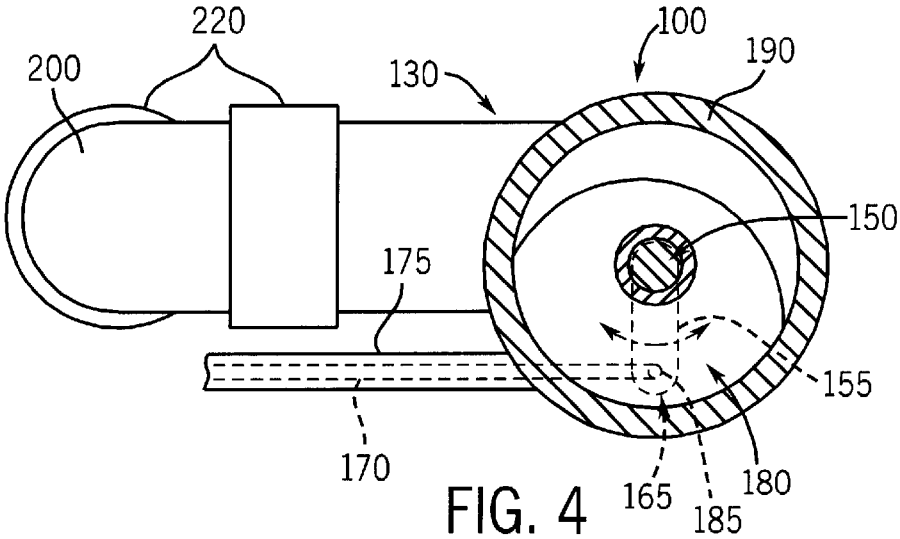
FIG. 4

OVERFLOW AND DRAIN CONTROL FOR A BATHTUB

CROSS REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

The present invention relates to a combined overflow and drain control for a bathing tub. The control is positionable in an overflow well surrounding the tub along a bottom surface of the well.

In many bathtubs an overflow opening is located through an upper portion of a vertical wall of the tub. The opening permits water to flow out to a sewer should the normal drain at the bottom of the tub be closed off or become clogged while water continues to flow into the tub in an unabated manner.

It is conventional to provide a decorative hood over such overflow openings to conceal them from view, while leaving a hole or gap to allow water to nevertheless reach the overflow opening. It is also known for a drain control knob or lever to be movably mounted relative to such hoods to link up to drain control devices by extending through the overflow opening. Further linkages connect such knobs or levers to drain valves at the bottom of the tubs. Thus, such assemblies provide overflow protection and also provide a means of controlling the tub drainage.

A variety of such assemblies exist. These range from assemblies which use electricity to control the valves (e.g. U.S. Pat. No. 4,945,579—see also U.S. Pat. No. 5,363,519), to assemblies relying on rigid rods and levers (e.g. U.S. Pat. No. 4,796,310), to assemblies that rely on sheathed cables (see e.g. U.S. Pat. Nos. 4,594,738 and 5,305,478).

In addition to conventional bathtubs that have a main basin with a top rim, in recent years there have been efforts to provide a more varied set of bathing experiences. For example, in U.S. Pat. No. 6,360,380 there was disclosed a deep basin of water that allowed an adult bather's entire torso and legs to be submerged underwater. Because this device needed to have such a high level of water the conventional overflow along the side of the tub was not used.

Rather, the basin was filled to the absolute top of it, and the tub was designed so that as a bather entered the excess water would spill into an overflow channel or well surrounding the tub. The overflow and drain control were placed along a side wall of the well.

However, this system was designed to recirculate water from the well to the main tub. Thus, an additional outlet was provided on the floor of the well (much as if it were a bathtub by itself).

While this system provided desirable additional bathing experiences, as an alternative it was desired to provide a somewhat similar basin with a surrounding spill well, but which did not provide for recirculation of spilled over water back to the main tub basin. The spilled over water would instead be simply drained to the sewer. Use of an overflow and drain control along the side wall of such a well could leave a stagnant standing pool of water in the well once water had reached the well, at least up to the level of the overflow hole.

Complicating the design of a drain control for such a tub is the fact that it is desirable to generally hide the drain control and overflow feature from view. Thus it is not desirable to mount the drain control along the top of the basin rim. Compare the placement of the control in U.S. Pat. No. 3,314,082.

Therefore, a need still existed for improved overflow and drain control structures for such tubs.

SUMMARY OF THE INVENTION

In one aspect the present invention provides an overflow and drain control assembly suitable for use with a bathing basin having a drain outlet and an overflow trough around the basin. The assembly has a drain channel with an essentially horizontal leg, an opening in an upper wall of the essentially horizontal leg, and a downwardly extending leg linked to the essentially horizontal leg.

There is also a drainpipe suitable for connection to the drain outlet of the basin and suitable to communicate with a disposal system. Also provided is a drain control assembly positioned at least partially in the drain channel to extend through the opening in the upper wall of the essentially horizontal leg, and also which extends outward from the drain channel.

A drain valve is mounted to the drainpipe. There is also a means for linking the drain control assembly to the drain valve such that movement of the drain control assembly causes movement of the drain valve.

In preferred forms the drain control assembly has a knob that is supported by a shaft, and the shaft in turn links to a conversion device for converting rotational motion of the knob into linear motion. An axis of rotation of the knob can be essentially vertical, and the means for linking can be a cable that moves in a sheath. If desired, the drain path can include an elbow portion linking the essentially horizontal leg to the downwardly extending leg.

In another aspect the invention provides a bathing tub. The tub can be a simple soaking tub, or can be provided with agitation systems such as hydrotherapy jets (e.g. spas or whirlpool tubs). In any event, there is a main basin including a basin floor having a drain opening in a bottom wall, and an overflow trough coupled to the main basin and essentially surrounding an upper portion of the basin, the trough having a bottom wall with an overflow opening there through.

The above assembly is then used with such tub structures. Because of the location of the assembly at the bottom wall of the trough, essentially all water that enters the overflow trough immediately drains from the overflow trough. Additionally, the device is substantially hidden from view (as being at the bottom of the narrow well). Further, the bent nature of the drain channel facilitates a compact assembly and minimizes leakage potential.

These and other advantages of the invention will be apparent from the detailed description and drawings which follow.

BRIEF DESCRIPTION OF THE DRAWINGS

FIG. 3 is a vertical cross-sectional view of a portion of FIG. 2; and

FIG. 4 is a partial cross-sectional view taken along line 4—4 of FIG. 3.

DETAILED DESCRIPTION OF THE PREFERRED EMBODIMENTS

Figure 1:
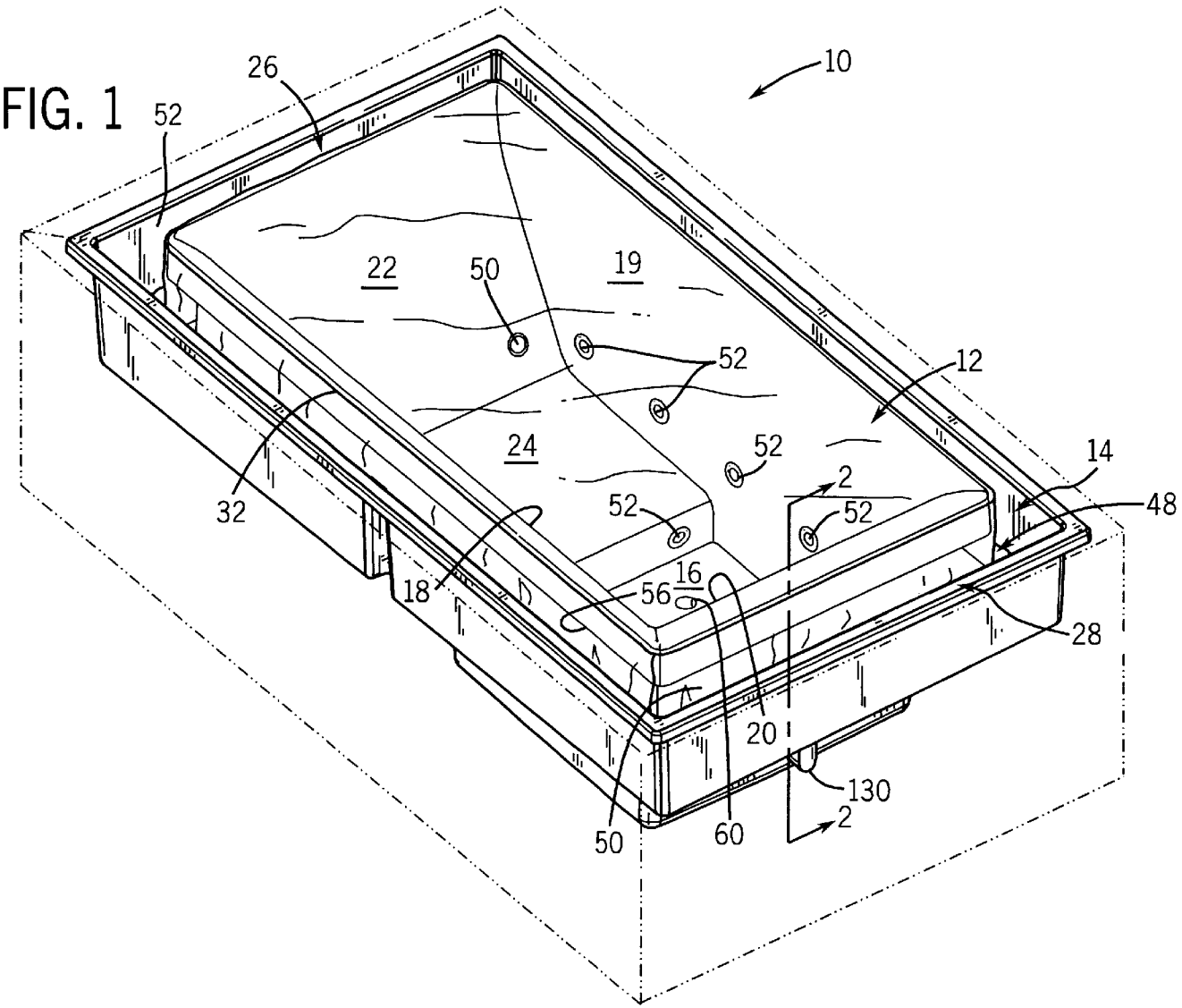
FIG. 1 is an upper, right, frontal perspective view of a bathtub in which an overflow and drain control device of the present invention could be applied.

Referring first to FIG. 1, a bathtub 10 includes a generally rectangular basin 12 surrounded about its perimeter at its upper end by an overflow trough 14 for receiving water flowing over the basin 12. In this embodiment the bathtub 10 is positioned within a skirted mounting island (shown in dotted lines). The usual faucet (not shown) is positioned such that when the tub is initially being filled the water will drop into the basin.

The basin 12 and overflow trough 14 can each be molded separately from a suitable material (such as fiberglass with a gel-coating applied to the top surfaces) to provide a smooth, high gloss finish on the inside of the basin 12 and overflow trough 14. The basin 12 and the overflow trough 14 can be joined together along the underside of the basin 12 by a high strength adhesive. Alternatively, the basin 12 and overflow trough 14 can be formed as a single piece.

The basin 12 has a bottom 16, generally upright side walls 18 and 19, a foot wall 20 and a backrest 22. The bottom 16 can have a raised seat 24 which transitions into the backrest 22 to form a reclined seat. A bather can be seated with his or her head at a head end 26 and feet at a foot end 28, or with his or her head at the foot end 28 which allows for a second seating position at an increased depth.

The side walls 18 and 19, foot wall 20 and backrest 22 extend up from the bottom 16 sufficiently high so that an average adult bather seated therein can be submerged up to his or her neck. Thus, the soaker bathtub 10 is considerably deeper than other types of bathtubs. Preferably, the basin is 25" deep at the foot end 28 and 20" deep at the head end 26.

Of course, these details of the basin are merely of a preferred embodiment. Numerous other configurations for the basin (e.g. oval) are possible, and there is no criticality to the floor or back rest areas of the basin.

The overflow trough 14 encircling the basin 12 forms a generally rectangular well/trough/channel having a bottom 48 and opposite inner 50 and outer 52 side walls. Unlike a conventional bathtub where the water cannot rise above a point a few inches below the rim (because of the presence of an overflow opening), the entire depth of the basin 12 can be filled with water.

When the water level reaches the rim 32, it spills into the overflow trough 14. The bottom 48 of the overflow trough 14 is pitched so that water therein runs from the head end 26 to an overflow orifice 110 at the foot end 28 (see especially FIG. 2). The conventional whirlpool suction orifices 50 link the tub water to a heater (not shown), and that water can be pumped by way of a recirculation pump (not shown) back into the tub through one or more injection orifices 52.

Referring again to FIG. 2, at the bottom 16 of the basin 12 is the usual drain orifice 60, which includes a drain control valve 260 that allows the drain orifice to be opened and closed to allow water to drain, or prevent water from draining, out of the bathtub 10 into a drainpipe 130. The operation of the drain control valve 260 is controlled by way of a drain control 100. As best seen from FIGS. 2–4, the drain control 100 has an upper hood 190 in which extends a control knob 140 which is mounted along a generally horizontal section of the drainpipe 130.

Note that the control 100 is mounted along the bottom 48 of the overflow trough 14. Consequently, all water that enters the overflow trough 14 immediately drains out of the overflow trough, instead of accumulating within the overflow trough up to a side wall overflow. Additionally, the drain control 100 is still largely hidden from view, and consequently does not negatively impact the overall aesthetic appearance of the bathtub. The control knob 140 is positioned over the overflow orifice 110 to largely shield the orifice from view.

Turning now to the details of the assembly, there is a knob 140 that is supported by a shaft 150 that extends substantially vertically into a first portion 160 of the drainpipe 130. The shaft 150 extends downward into a first conversion device 180 preferably directly below the horizontal portion of the drainpipe 130. O-rings 145 are positioned at one or more points along the length of the shaft 150 to prevent leakage of water into the first conversion device 180. The first conversion device 180, which can be formed integrally with the drainpipe 130 or is otherwise supported by the drainpipe, is a structure for converting rotational motion of the knob 140/shaft 150 into linear motion of a cable 170. The cable 170 can be coaxially embedded within a sheath 175 made from rubber, plastic, etc.

As shown particularly in FIG. 4, in one embodiment, the first conversion device 180 includes an arm 155 that is attached to the bottom of the shaft 150, where a far end 165 of the arm is attached to the cable 170 by way of a pin 185. Consequently, as the shaft 150 is rotated, the cable 170 is moved relative to the sheath 175. This embodiment of the first conversion device 180 can be compared with the conversion device shown in FIG. 3 of U.S. Pat. No. 4,594,738.

Figure 2:
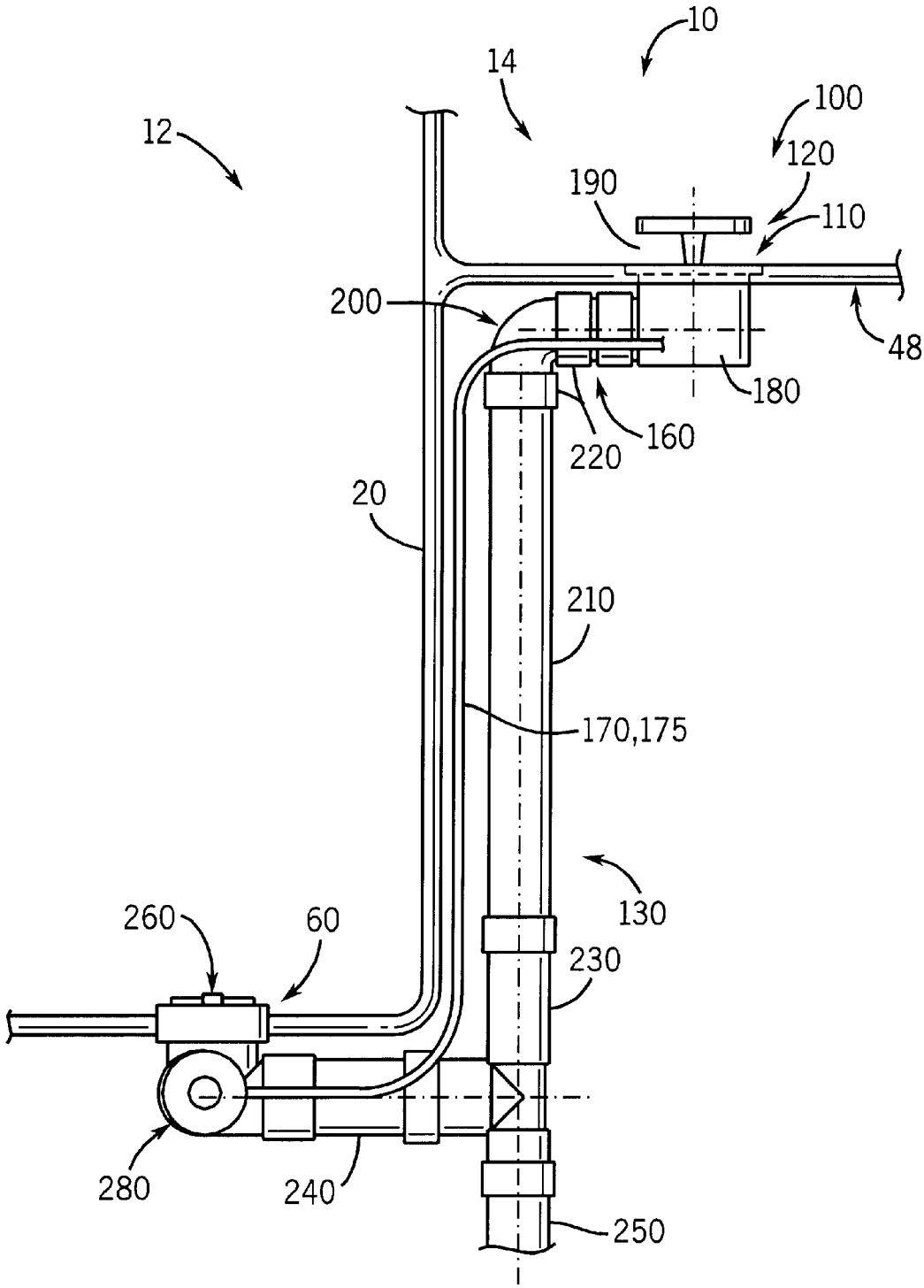
FIG. 2 is a highly enlarged partial cross-sectional view taken along line 2—2 of FIG. 1.

Also as shown in FIGS. 2 and 3, the overflow opening 110 extends coaxially around the shaft 150. Flange 190 has a downwardly-directed inner surface 195 (which in alternate embodiments can be convex). Water drains from the overflow trough 14, through the overflow opening 110 down along the inner surface 195 and into the drainpipe 130 which ultimately connects to a sewer.

The first portion 160 of the drainpipe 130 extends in a generally horizontal direction until it reaches an elbow 200. From the elbow 200 a second portion 210 of the drainpipe 130 extends in a generally vertical direction. Conversion device 180 therefore has a position for location that is adjacent the.tub, yet in proper alignment relative to the shaft 150 and knob 140. The elbow 200 can be connected to the first and second portions 160,210 by way of standard threaded coupling portions 220.

Second portion 210 of the drainpipe 130 in turn is coupled to portion 230 of the drainpipe 130, which is T-shaped. The T-shaped portion 230 is linked in the usual manner to a vertical pipe 250 extending to the sewer and a generally horizontal pipe 240. The latter is coupled to the drain opening 60.

Located within the drain opening 60 is the drain control valve 260, the positioning of which is determined by movement of the cable 170 through facilitation by way of a second conversion device 280. The latter device converts linear motion of the cable into vertical linear motion of the drain control valve 260.

In one embodiment, the second conversion device 280 is similar to the first conversion device 180 in that the cable 170 is coupled to a first arm that is attached to a rotatable shaft (not shown). As movement of the cable and consequently the first arm occurs, the shaft is rotated, and an additional arm (not shown) attached to the shaft is thus also rotated. The drain control valve 260, which rests upon the additional arm, moves upward when so forced by the additional arm, and moves downward due to gravity when the additional arm is retracted. This embodiment can be compared with that shown in U.S. Pat. No. 4,594,738. Thus, rotation of the knob 140 along a vertical axis causes corresponding upward or downward movement of the drain control valve 260.

Importantly, the design is suitable for use with tubs having a variety of sloped walls 20 as the length of the elbow will ensure enough of a gap between the pipe 210 and the wall 20 to permit sloping of the wall 20 such as at a back rest. The design of the drain control 100 is suitable for implementation at different locations along the overflow trough 14, alongside different walls than the foot wall 20.

A variety of alternate embodiments of the present invention are possible in addition to those shown. Most particularly, it is envisioned that another preferred bathtub will have a generally oval basin surrounded by a generally oval overflow trough. Also, while the preferred tubs have no recirculation to the main basin from the overflow trough, such tubs could be provided with recirculation systems instead of dumping the overflow water to the sewer.

Further, while a cable linkage is the most preferred linkage, it will be appreciated that other types of linkages (e.g. mechanical; electrical) are also possible. Moreover, a rotational knob can be replaced with other activation mechanisms (e.g. compare U.S. Pat. No. 4,796,310 which uses a lever).

Thus, while the foregoing illustrates and describes the preferred embodiments of the present invention, reference should be made to the following claims, rather than to just the foregoing specification, as indicating the scope of the invention.

INDUSTRIAL APPLICABILITY

The invention provides overflow and drain control assemblies, particularly those useful in connection with overflow troughs around bathing basins.

What is claimed is:

1. An overflow and drain control assembly suitable for use with a bathing basin having a drain outlet and an overflow trough around the basin, the assembly comprising:

a drain channel having an essentially horizontal leg, an opening in an upper wall of the essentially horizontal leg, and a downwardly extending leg linked to the essentially horizontal leg;

a drainpipe suitable for connection to the drain outlet of the basin and suitable to communicate with a disposal system;

a drain control assembly positioned at least partially in the drain channel to extend through the opening in the upper wall of the essentially horizontal leg, and also which extends outward from the drain channel;

a drain valve mounted to the drainpipe; and means for linking the drain control assembly to the drain valve such that movement of the drain control assembly causes movement of the drain valve.

2. The overflow and drain control assembly of claim 1, wherein the drain control assembly has a knob that is supported by a shaft, the shaft in turn linking to a conversion device for converting rotational motion of the knob into linear motion.

3. The overflow and drain control assembly of claim 2, wherein an axis of rotation of the knob is essentially vertical.

4. The overflow and drain control assembly of claim 1, wherein the means for linking comprises a cable that moves in a sheath.

5. The overflow and drain control assembly of claim 1, wherein the drain path includes an elbow portion linking the essentially horizontal leg to the downwardly extending leg.

6. A bathing, tub, comprising:

a main basin including a basin floor having a drain opening in a bottom wall;

an overflow trough coupled to the main basin and essentially surrounding an upper portion of the basin, the trough having a bottom wall with an overflow opening there through;

a drain channel mounted to the overflow opening and having an essentially horizontal leg, an opening in an upper wall of the essentially horizontal leg in essential alignment with the overflow opening, and a downwardly extending leg linked to the essentially horizontal leg;

a drainpipe connected to the basin drain opening and suitable to communicate with a disposal system;

a drain control assembly positioned at least partially in the drain channel to extend through the opening in the upper wall of the essentially horizontal leg into the trough, and also to extend outward from the drain path;

a drain valve mounted to the drainpipe; and means for linking the drain control assembly to the drain valve such that movement of the drain control assembly causes movement of the drain valve.

* * * * *